US007306888B2

(12) United States Patent
Baker et al.

(10) Patent No.: US 7,306,888 B2
(45) Date of Patent: Dec. 11, 2007

(54) DRY ELECTROPHOTOGRAPHIC TONERS COMPRISING AMPHIPATHIC COPOLYMERS HAVING ACIDIC FUNCTIONALITY

(75) Inventors: James A. Baker, Hudson, WI (US); Ronald J. Moudry, Woodbury, MN (US); Zbigniew Tokarski, Woodbury, MN (US); Julie Y. Qian, Aurora, IL (US)

(73) Assignee: Samsung Electronics Company, Suwon (KR)

( * ) Notice: Subject to any disclaimer, the term of this patent is extended or adjusted under 35 U.S.C. 154(b) by 434 days.

(21) Appl. No.: 10/881,023

(22) Filed: Jun. 30, 2004

(65) Prior Publication Data

US 2006/0003247 A1 Jan. 5, 2006

(51) Int. Cl.
*G03G 9/00* (2006.01)

(52) U.S. Cl. ..... 430/109.3; 430/110.2

(58) Field of Classification Search ..... 430/110.2
See application file for complete search history.

(56) References Cited

U.S. PATENT DOCUMENTS

| | | | | |
|---|---|---|---|---|
| 4,298,672 | A | 11/1981 | Lu | 430/108 |
| 4,560,635 | A | 12/1985 | Hoffend et al. | 430/106.6 |
| 4,656,112 | A | 4/1987 | Kawagishi et al. | 430/110 |
| 4,845,003 | A | 7/1989 | Kiriu et al. | 430/110 |
| 4,931,975 | A * | 6/1990 | Gleason et al. | 700/274 |
| 4,937,157 | A | 6/1990 | Haack et al. | 430/110 |
| 5,176,974 | A | 1/1993 | Till et al. | 430/42 |
| 5,288,580 | A * | 2/1994 | Julien et al. | 430/108.23 |
| 5,422,217 | A * | 6/1995 | Ueyama et al. | 430/109.4 |
| 2004/0091805 | A1 * | 5/2004 | Qian et al. | 430/109.1 |
| 2004/0091806 | A1 | 5/2004 | Qian et al. | 430/109.31 |
| 2005/0250032 | A1 * | 11/2005 | Tokarski et al. | 430/108.21 |
| 2005/0250035 | A1 * | 11/2005 | Moudry et al. | 430/108.23 |

FOREIGN PATENT DOCUMENTS

| | | |
|---|---|---|
| WO | WO01/79316 | 10/2001 |

* cited by examiner

*Primary Examiner*—Mark F. Huff
*Assistant Examiner*—Peter Vajda
(74) *Attorney, Agent, or Firm*—Kagan Binder, PLLC

(57) ABSTRACT

Dry electrophotographic toner compositions are provided comprising an amphipathic copolymer comprising acidic functionality covalently bonded to the amphipathic copolymer. Methods of making the toner compositions are also provided. The present toner compositions exhibit unique charge characteristics and unique chemical and charge interaction properties.

19 Claims, No Drawings

DRY ELECTROPHOTOGRAPHIC TONERS COMPRISING AMPHIPATHIC COPOLYMERS HAVING ACIDIC FUNCTIONALITY

FIELD OF THE INVENTION

The invention relates to electrophotographic toners. More specifically, the invention relates to dry toner compositions comprising toner particles prepared from amphipathic copolymers having acidic functionality.

BACKGROUND

Electrography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like. Electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light", may include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

Liquid inks using gel organosol compositions have been described WO 01/79316. The liquid toner composition as described therein provides a rapidly self-fixing ink, wherein the ink is comprised of a polymeric binder in the form of a graft copolymer gel formed by acid/base interactions, that is dispersed in an organic solvent or solvent blend having a Kauri-Butanol (KB) number less than 30.

SUMMARY OF THE INVENTION

The present invention provides dry electrophotographic toner compositions comprising an amphipathic copolymer comprising one or more S material portions and one or more D material portions, wherein the amphipathic copolymer comprises at least one acidic functionality covalently bonded to the amphipathic copolymer. The toner compositions as provided herein exhibit unique charge characteristics and unique chemical and charge interaction properties.

In a preferred embodiment, binder particles as described herein provide inherently generated negative toner particles. In a preferred embodiment of the present invention, the copolymer comprises sufficient acidic functionality to provide toner compositions that are negatively charged without the need to incorporate negative charge control agents. Alternatively, negative charge control agents may be incorporated to provide unique charge and/or chemical interaction properties. In another embodiment, positive charge control agents may be incorporated in the toner compositions. The positive charge control agents may be incorporated in an amount to modulate the overall effective negative charge of the toner composition, or in an amount sufficient to provide a toner composition having a positive charge. In either such case, the incorporation of positive charge control agents provides a toner composition exhibiting unique charge and/or chemical interaction properties.

In another aspect of the invention, a method of making a dry electrophotographic toner composition is provided, comprising the steps of forming an amphipathic copolymer that incorporates an acidic functionality in the S material portion and/or D material portion of the amphipathic copolymer; and formulating the resulting amphipathic copolymer into a dry electrophotographic toner composition. In a preferred embodiment, this method comprises copolymerizing an acidic-functional polymerizable compound into the S material portion and/or D material portion of the amphipathic copolymer.

DETAILED DESCRIPTION

The binder of a toner composition fulfills functions both during and after electrophotographic processes. With respect to processability, the character of the binder impacts the triboelectric charging and charge retention characteristics, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons. Glass transition temperature, $T_g$, refers to the temperature at which a (co)polymer, or portion thereof, changes from a hard, glassy material to a rubbery, or viscoelastic, material, corresponding to a dramatic increase in free volume as the (co)polymer is heated. The $T_g$ can be calculated for a (co)polymer, or portion thereof, using known $T_g$ values for the high molecular weight homopolymers and the Fox equation expressed below:

$$1/T_g = w_1/T_{g1} + w_2 T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54-55 (1992).

In the practice of the present invention, values of $T_g$ for the polymer of the binder or portions thereof (such as the D or S portion of the graft copolymer) may be determined using the Fox equation above, although the $T_g$ of the copolymer as a whole may be determined experimentally using e.g., differential scanning calorimetry. The glass transition temperatures ($T_g$'s) of the S and D portions may vary over a wide range and may be independently selected to enhance manufacturability and/or performance of the resulting toner particles. The $T_g$'s of the S and D portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

As used herein, the term "amphipathic" refers to a copolymer having a combination of portions having distinct solubility and dispersibility characteristics in a desired liquid carrier that is used to make the copolymer. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier. From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer."

Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

The relative amounts of S and D portions in a copolymer can impact the solvating and dispersibility characteristics of these portions. For instance, if too little of the S portion(s) are present, the copolymer may have too little stabilizing effect to sterically-stabilize the organosol with respect to aggregation as might be desired. If too little of the D portion(s) are present, there may be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material (i.e. core/shell ratio) is in the range of 1:20 to 20:1, preferably 1:1 to 15:1, more preferably 2:1 to 10:1, and most preferably 4:1 to 8:1.

The solubility of a material, or a portion of a material such as a copolymeric portion, may be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters*, 2d Ed. CRC Press, Boca Raton, Fla., (1991), for monomers and representative polymers in *Polymer Handbook*, 3rd Ed., J. Brandrup & E. H. Immergut, Eds. John Wiley, N.Y., pp 519-557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier may be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

Consequently, in preferred embodiments, the absolute difference between the respective Hildebrand solubility parameters of the S portion(s) of the copolymer and the liquid carrier is less than 3.0 MPa $^{1/2}$, preferably less than about 2.0 $MPa^{1/2}$, more preferably less than about 1.5 $MPa^{1/2}$. In a particularly preferred embodiment of the present invention, the absolute difference between the respective Hildebrand solubility parameters of the S portion(s) of the copolymer and the liquid carrier is from about 2 to about 3.0 $MPa^{1/2}$. Additionally, it is also preferred that the absolute difference between the respective Hildebrand solubility parameters of the D portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D portion(s) is at least about 0.4 $MPa^{1/2}$, more preferably at least about 1.0 $MPa^{1/2}$. Because the Hildebrand solubility of a material may vary with changes in temperature, such solubility parameters are preferably determined at a desired reference temperature such as at 25° C.

Those skilled in the art understand that the Hildebrand solubility parameter for a copolymer, or portion thereof, may be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446-448. Thus, there will be a preferred molecular weight range for a given polymer or portion thereof in order to achieve desired solvating or dispersing characteristics. Similarly, the Hildebrand solubility parameter for a mixture may be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. limmergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table Ia lists Hildebrand solubility parameters for some common solvents used in an electrophotographic toner and the Hildebrand solubility parameters and glass transition temperatures (based on their high molecular weight homopolymers) for some common monomers used in synthesizing organosols.

TABLE Ia

Hildebrand Solubility Parameters

Solvent Values at 25° C.

| Solvent Name | Kauri-Butanol Number by ASTM Method D1133-54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl Acrylate | 16.74 | <−55 (58 m.p.)** |
| n-Octadecyl Methacrylate | 16.77 | −100 (45 m.p.)** |
| n-Octadecyl Acrylate | 16.82 | −55 |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P.A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).

*Polymer Handbook, 3rd Ed., J. Brandrup E. H. Immergut, Eds., John Wiley, NY, pp. VII/209-277 (1989). The $T_g$ listed is for the homopolymer of the respective monomer.

**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The substantially nonaqueous carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

The core/shell structure of the binder particles tends to be retained when the particles are dried when incorporated into toner compositions.

The materials of the polymeric binder particle are preferably selected to provide inherently negative toner particles. As a general principle, such polymers include styrene, styrene butyl acrylate, styrene butyl methacrylate and certain polyesters. When the overall tendency of the polymers used in the polymeric binder particle would result in a negative toner particle, positively charged charge control additives may optionally be incorporated as described herein in a manner effective to impart an overall positive charge to the toner particle.

Alternatively, the polymers of the polymeric binder particle may be used that will inherently result in particles having a positive charge. As a general principle, many acrylate and methacrylate based polymers generate inherently positive toner particles. Preferred such polymers include polymers formed comprising one or more C1-C18 esters of acrylic acid or methacrylic acid monomers. Particular acrylates and methacrylates that are preferred for incorporation into amphipathic copolymers for binder particles include isononyl (meth)acrylate, isobornyl (meth) acrylate, 2-ethylhexyl (meth)acrylate, isobutyl (meth)acrylate, isodecyl (meth)acrylate, lauryl (dodecyl) (meth) acrylate, stearyl (octadecyl) (meth)acrylate, behenyl (meth) acrylate, n-butyl (meth)acrylate, methyl (meth)acrylate, ethyl (meth)acrylate, hexyl (meth)acrylate, isooctyl (meth) acrylate, combinations of these, and the like.

Preferred graft amphipathic copolymers that may be formulated to further incorporate acidic functionality for use in the present binder particles are described in Qian et al, U.S. Ser. No. 10/612,243, filed on Jun. 30, 2003, entitled ORGANOSOL INCLUDING AMPHIPATHIC COPOLYMERIC BINDER AND USE OF THE ORGANOSOL TO MAKE DRY TONERS FOR ELECTROGRAPHIC APPLICATIONS and Qian et al., U.S. Ser. No. 10/612,535, filed on Jun. 30, 2003, entitled ORGANOSOL INCLUDING AMPHIPATHIC COPOLYMERIC BINDER HAVING CRYSTALLINE MATERIAL, AND USE OF THE ORGANOSOL TO MAKE DRY TONER FOR ELECTROGRAPHIC APPLICATIONS for dry toner compositions.

Acidic functionality is incorporated into the binder particle by forming an amphipathic copolymer that incorporates an acidic functionality in the S material portion and/or D material portion of the amphipathic copolymer. In a preferred embodiment of the present invention, the acidic functionality is provided in the D material portion of the amphipathic copolymer. Surprisingly, the charge effect of the acidic functionality is apparent even when the functionality is located in the core, rather than the outside, of the binder particle. The acidic functionality is preferably selected from carboxylic acid, sulfonic acid and phosphoric acidic-functionalities.

The acidic functionality is linked to the amphipathic copolymer by an appropriate linking group. Examples of preferred linking groups include a direct bond or a $—(CH_2)_m$- group, where m is an integer between 1 and 20, inclusive, and one or more of the methylene groups is optionally replaced by O, S, N, C, B, Si, P, C═O, O═S═O, a heterocyclic group, an aromatic group, an $NR_a$ group, a $CR_b$ group, a $CR_cR_d$ group, a $SiR_eR_f$ group, a $BR_g$ group, or a $P(═O)R_h$ group, where $R_a$, $R_b$, $R_c$, $R_d$, $R_e$, $R_f$, $R_g$, and $R_h$ are, each independently, a bond, H, a hydroxyl group, a thiol group, a carboxyl group, an amino group, a halogen, and alkyl group, an acyl group, an alkoxy group, an alkylsulfanyl group, and alkenyl group, such as a vinyl group, an allyl group, and a 2-phenylethenyl group, an alkynyl group, a heterocyclic group, and aromatic group, or a part of a ring group, such as cycloalkyl groups, heterocylic groups or a benzo group.

The incorporation of acidic functionality is preferably carried out by providing a plurality of free radically polymerizable monomers, wherein at least one of the monomers comprises a first reactive functionality and free radically polymerizing the monomers in a solvent to form a first reactive functional polymer, wherein the monomers and the first reactive functional polymer are soluble in the solvent. A compound having a second reactive functionality that is reactive with the first reactive functionality and free radically polymerizable functionality is then reacted with the first reactive functional polymer under conditions such that at least a portion of the second reactive functionality of the compound reacts with at least a portion of the first reactive functionality of the polymer to form one or more linkages by which the compound is linked to the polymer, thereby providing an S material portion polymer with pendant free radically polymerizable functionality. Ingredients comprising (i) the S material portion polymer with pendant free radically polymerizable functionality, (ii) one or more free radically polymerizable monomers, and (iii) a liquid carrier in which polymeric material derived from ingredients comprising the one or more additional monomers of ingredient (ii) is insoluble are then copolymerized under conditions effective to form an amphipathic copolymer having S material and D material portions. At least one acidic-functional polymerizable compound is provided in either or both of the polymerization steps to form the S material portion or the D material portion to incorporate acidic functionality in the amphipathic copolymer. In a preferred embodiment of the present invention, the monomers comprising the acidic functionality comprise greater than about 1%, and more preferably from about 2 to about 8% by weight of the total amphipathic copolymer.

Preferred acidic-functional polymerizable compounds include acid polymerizable compounds include acrylic acid, 2-acrylamido-2-methyl propane sulfonic acid, 2-carboxyethyl acrylate, crotonic acid, itaconic acid, maleic acid, methacrylic acid, pentaerythritol dimethacrylate, styrene sulfonic acid, 4-vinyl benzoic acid, and mixtures thereof.

Polymeric binder materials suitable for use in dry toner particles typically have a high glass transition temperature ($T_g$) of at least about 50-65° C. in order to obtain good blocking resistance after fusing, yet typically require high fusing temperatures of about 200-250° C. in order to soften or melt the toner particles and thereby adequately fuse the toner to the final image receptor. High fusing temperatures are a disadvantage for dry toner because of the long warm-up time and higher energy consumption associated with high temperature fusing and because of the risk of fire associated with fusing toner to paper at temperatures approaching the autoignition temperature of paper (233° C.). In addition, some dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset. Alternatively, various lubricants or waxes have been physically blended into the dry toner particles during fabrication to act as release or slip agents; however, because these waxes are not chemically bonded to the polymeric binder, they may adversely affect triboelectric charging of the toner particle or may migrate from the toner particle and contaminate the photoreceptor, an intermediate transfer element, the fuser element, or other surfaces critical to the electrophotographic process.

Generally, the volume mean particle diameter ($D_v$) of the toner particles, determined by laser diffraction particle size measurement, preferably should be in the range of about 0.05 to about 50.0 microns, more preferably in the range of about 3 to about 10 microns, most preferably in the range of about 5 to about 7 microns.

The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

The toner particles of the present invention may additionally comprise one or more additives as desired. Additional additives include, for example, UV stabilizers, mold inhibitors, bactericides, fungicides, antistatic agents, anticaking agents, gloss modifying agents, other polymer or oligomer material, antioxidants, and the like.

The additives may be incorporated in the binder particle in any appropriate manner, such as combining the binder particle with the desired additive and subjecting the resulting composition to one or more mixing processes. Examples of such mixing processes include homogenization, microfluidization, ball-milling, attritor milling, high energy bead (sand) milling, basket milling or other techniques known in the art to reduce particle size in a dispersion. The mixing process acts to break down aggregated additive particles, when present, into primary particles (preferably having a diameter of from about 0.005 to about 5 microns, more preferably having a diameter of from about 0.05 to about 3 microns, and most preferably having a diameter of from about 0.1 to about 1 microns) and may also partially shred the binder into fragments that can associate with the additive. According to this embodiment, the copolymer or fragments derived from the copolymer then associate with the additives. Optionally, one or more visual enhancement agents may be incorporated within the binder particle, as well as coated on the outside of the binder particle.

One or more charge control agents can be added before or after this mixing process, if desired. Charge control agents are often used in dry toner when the other ingredients, by themselves, do not provide the desired triboelectric charging or charge retention properties. The amount of the charge control agent, based on 100 parts by weight of the toner solids, is generally 0.01 to 10 parts by weight, preferably 0.1 to 5 parts by weight.

Examples of negative charge control agents for the toner include organometal complexes and chelate compounds. Representative complexes include monoazo metal complexes, acetylacetone metal complexes, and metal complexes of aromatic hydroxycarboxylic acids and aromatic dicarboxylic acids. Additional negative charge control agents include aromatic hydroxylcarboxylic acids, aromatic mono- and poly-carboxylic acids, and their metal salts, anhydrides, esters, and phenolic derivatives such as bisphenol. Other negative charge control agents include zinc compounds as disclosed in U.S. Pat. No. 4,656,112 and aluminum compounds as disclosed in U.S. Pat. No. 4,845,003.

Examples of commercially available negatively charged charge control agents include zinc 3,5-di-tert-butyl salicylate compounds, such as BONTRON E-84, available from Orient Chemical Company of Japan; zinc salicylate compounds available as N-24 and N-24HD from Esprix Technologies; aluminum 3,5-di-tert-butyl salicylate compounds, such as BONTRON E-88, available from Orient Chemical Company of Japan; aluminum salicylate compounds available as N-23 from Esprix Technologies; calcium salicylate compounds available as N-25 from Esprix Technologies; zirconium salicylate compounds available as N-28 from Esprix Technologies; boron salicylate compounds available as N-29 from Esprix Technologies; boron acetyl compounds available as N-31 from Esprix Technologies; calixarenes, such as such as BONTRON E-89, available from Orient Chemical Company of Japan; azo-metal complex Cr (III) such as BONTRON S-34, available from Orient Chemical Company of Japan; chrome azo complexes available as N-32A, N-32B and N-32C from Esprix Technologies; chromium compounds available as N-22 from Esprix Technologies and PRO-TONER CCA 7 from Avecia Limited; modified inorganic polymeric compounds such as Copy Charge N4P from Clariant; and iron axo complexes available as N-33 from Esprix Technologies.

Examples of positive charge control agents for the toner include nigrosine; modified products based on metal salts of fatty acids; quaternary-ammonium-salts such as tributylbenzylammonium-1-hydroxy-4-naphthosulfonic acid or tetrabutylammonium tetrafluoroborate; alkyl pyridinium halides, including cetyl pyridinium chloride and others as disclosed in U.S. Pat. No. 4,298,672; sulfates and bisulfates, including distearyl dimethyl ammonium methyl sulfate as disclosed in U.S. Pat. No. 4,560,635; distearyl dimethyl ammonium bisulfate as disclosed in U.S. Pat. No. 4,937,157, U.S. Pat. No. 4,560,635; onium salts analogous to the quaternary-ammonium-salts such as phosphonium salts, and lake pigments of these; triphenylmethane dyes, and lake pigments of these; metal salts of higher fatty acids; diorgano tin oxides such as dibutyl tin oxide, dioctyl tin oxide, and dicyclohexyl tin oxide; and diorgano tin borates such as dibutyl tin borate, dioctyl tin borate, and dicyclohexyl tin borate.

Further, homopolymers of monomers having the following general formula (1) or copolymers with the foregoing polymerizable monomers such as styrene, acrylic acid esters, and methacrylic acid esters may be used as the positive charge control agent. In that case, those charge control agents have functions also as (all or a part of) binder resins.

(1)

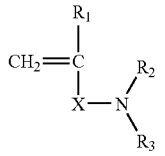

$R_1$ is H or $CH_3$;

X is a linking group, such as a $—(CH_2)_m—$ group, where m is an integer between 1 and 20, inclusive, and one or more of the methylene groups is optionally replaced by —O—, —(O)C—, —O—C(O)—, —(O)C—O—. Preferably, X is selected from alkyl,

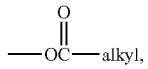

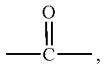

and alkyl-O-alkyl, where the alkyl group has from 1 to 4 carbons.

$R_2$ and $R_3$ are independently a substituted or unsubstituted alkyl group having (preferably 1 to 4 carbons).

Examples of commercially available positive charge control agents include azine compounds such as BONTRON N-01, N-04 and N-21; and quaternary ammonium salts such as BONTRON P-51 from Orient Chemical Company and P-12 from Esprix Technologies; and ammonium salts such as "Copy Charge PSY" from Clariant.

Preferably, the charge control agent is colorless, so that the charge control agent does not interfere with the presentation of the desired color of the toner. In another embodiment, the charge control agent exhibits a color that can act as an adjunct to a separately provided colorant, such as a pigment. Alternatively, the charge control agent may be the sole colorant in the toner. In yet another alternative, a pigment may be treated in a manner to provide the pigment with a positive charge.

Examples of negative charge control agents having a color or negatively charged pigments include Copy Charge NY VP 2351, an Al-azo complex from Clariant; Hostacoply N4P-N101 VP 2624 and Hostacoply N4P-N203 VP 2655, which are modified inorganic polymeric compounds from Clariant. Examples of positive charge control agents having a color or positively charged pigments include Copy Blue PR, a triphenylmethane from Clariant.

The preferred amount of charge control agent for a given toner formulation will depend upon a number of factors, including the composition of the polymer binder. The preferred amount of charge control agent further depends on the composition of the S portion of the graft copolymer, the composition of the organosol, the molecular weight of the organosol, the particle size of the organosol, the core/shell ratio (i.e. c/s ratio by weight) of the graft copolymer, the pigment used in making the toner, and the ratio of organosol to pigment. In addition, preferred amounts of charge control agent will also depend upon the nature of the electrophotographic imaging process, particularly the design of the developing hardware and photoreceptive element. It is understood, however, that the level of charge control agent may be adjusted based on a variety of parameters to achieve the desired results for a particular application.

Dry electrophotographic toner compositions of the present invention may be prepared by techniques as generally described above, including the steps of forming an amphipathic copolymer that incorporates an acidic functionality in the S material portion and/or D material portion of the amphipathic copolymer; and formulating the resulting amphipathic copolymer into a dry electrophotographic toner composition. As noted above, the amphipathic copolymer is prepared in a liquid carrier to provide a copolymer having portions with the indicated solubility characteristics. Addition of components of the ultimate toner composition, such as charge control agents or visual enhancement additives, can optionally be accomplished during the formation of the amphipathic copolymer. The step of formulating the resulting amphipathic copolymer into a dry electrophotographic toner composition comprises removing the carrier liquid from the composition to the desired level so that the composition behaves as a dry toner composition, and also optionally incorporating other desired additives such as charge control agents, visual enhancement additives, or other desired additives such as described herein to provide the desired toner composition. Surprisingly, it has been found that toner compositions of the present invention may comprise up to about 30% of carrier liquid by weight, while exhibit performance properties of a dry toner composition. Preferably, the toner composition comprises less than about 20%, and more preferably less than about 10% of carrier liquid by weight.

The resulting toner particle may optionally be further processed by additional coating processes or surface treatment such as spheroidizing, flame treating, and flash lamp treating.

The toner particles may then be provided as a toner composition, ready for use, or blended with additional components to form a toner composition.

Toners of the present invention are in a preferred embodiment used to form images in electrophotographic processes. While the electrostatic charge of either the toner particles or photoreceptive element may be either positive or negative, electrophotography as employed in the present invention is preferably carried out by dissipating charge on a positively charged photoreceptive element. A positively-charged toner is then applied to the regions in which the positive charge was dissipated using a toner development technique.

The invention will further be described by reference to the following nonlimiting examples.

EXAMPLES

Glossary of Chemical Abbreviations & Chemical Sources

The following raw materials were used to prepare the polymers in the examples which follow:

AIBN: Azobisisobutyronitrile (a free radical forming initiator available as VAZO-64 from DuPont Chemical Co., Wilmington, Del.)

nBA: normal-Butyl acrylate (available from Aldrich Chemical Co., Milwaukee, Wis.)

CEA: 2-Carboxyethyl acrylate (available from Aldrich Chemical Co., Milwaukee, Wis.)

DBTDL: Dibutyl tin dilaurate (a catalyst available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

MAA: Methacrylate acid (Aldrich Chemical Co., Milwaukee, Wis.)

St: Styrene (available from Aldrich Chemical Co., Milwaukee, Wis.)

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

V-601: Dimethyl 2,2'-azobisisobutyrate (a free radical forming initiator available as V-601 from WAKO Chemicals U.S.A., Richmond, Va.)

Zirconium HEX-CEM: (metal soap, zirconium tetraoctoate, available from OMG Chemical Company, Cleveland, Ohio)

Test Methods

The following test methods were used to characterize the polymer and toner samples in the examples that follow:

Solids Content of Solutions

In the following toner composition examples, percent solids of the graft stabilizer solutions, the organosol, and milled liquid toner dispersions were determined thermo-gravimetrically by drying in an aluminum weighing pan an originally-weighed sample at 160° C. for two to three hours, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Graft Stabilizer Molecular Weight

Various properties of the graft stabilizer have been determined to be important to the performance of the stabilizer, including molecular weight and molecular weight polydispersity. Graft stabilizer molecular weight is normally expressed in terms of the weight average molecular weight ($M_w$), while molecular weight polydispersity is given by the ratio of the weight average molecular weight to the number average molecular weight ($M_w/M_n$). Molecular weight parameters were determined for graft stabilizers with gel permeation chromatography (GPC) using tetrahydrofuran as the carrier solvent. Absolute $M_w$ was determined using a Dawn DSP-F light scattering detector (commercially obtained from Wyatt Technology Corp, Santa Barbara, Calif.), while polydispersity was evaluated by ratioing the measured $M_w$ to a value of $M_n$ determined with an Optilab 903 differential refractometer detector (commercially obtained from Wyatt Technology Corp, Santa Barbara, Calif.).

Particle Size

The organosol particle size distributions were determined using a Horiba LA-920 laser diffraction particle size analyzer (commercially obtained from Horiba Instruments, Inc, Irvine, Calif.) using Norpar™ 12 fluid that contains 0.1% Aerosol OT (dioctyl sodium sulfosuccinate, sodium salt, Fisher Scientific, Fairlawn, N.J.) surfactant. The dry toner particle size distributions were determined using a Horiba LA-900 laser diffraction particle size analyzer (commercially obtained from Horiba Instruments, Inc, Irvine, Calif.) using de-ionized water that contains 0.1% Triton X-100 surfactant (available from Union Carbide Chemicals and Plastics, Inc., Danbury, Conn.).

In both procedures, the samples were diluted by approximately 1/500 by volume and sonicated for one minute prior to measurement. Sonication on the Horiba LA-920 was at 150 watts and 20 kHz. The particle size was expressed on a number-average basis in order to provide an indication of the dominance of the fundamental (primary) particle size of the particles or was expressed on a volume-average basis in order to provide an indication of the dominance of the coalesced primary particle aggregate size of the particles.

Toner Charge (Blow-Off Q/M)

One important characteristic of xerographic toners is the toner's electrostatic charging performance (or specific charge), given in units of Coulombs per gram. The specific charge of each toner was established in the examples below using a blow-off tribo-tester instrument (Toshiba Model TB200 Blow-Off Powder Charge measuring apparatus with size #400 mesh stainless steel screens pre-washed in tetrahydrofuran and dried over nitrogen, Toshiba Chemical Co., Tokyo, Japan). To use this device, the toner was first electrostatically charged by combining it with a carrier powder. The carrier is a ferrite powder coated with a polymeric shell. The toner and the coated carrier particles were brought together to form the developer in a plastic container. When the developer was gently agitated using a U.S. Stoneware mill mixer, tribocharging results in both of the component powders acquiring an equal and opposite electrostatic charge, the magnitude of which is determined by the properties of the toner and carrier, along with any compounds optionally added to the toner to affect the charging and flowability (e.g., charge control agents, silica, and the like).

Once charged, the developer mixture was placed in a small holder inside the blow-off tribo-tester. The holder acts as a charge-measuring Faraday cup that is attached to a sensitive capacitance meter. The cup has a connection to a compressed dry nitrogen gas line and a fine screen at its base that is sized to retain the larger carrier particles while allowing passage of the smaller toner particles. When the gas line is pressurized, gas flows through the cup and forces the toner particles out of the cup through the fine screen. The carrier particles remain in the Faraday cup. The capacitance meter in the tester measures the charge of the carrier where the charge on the toner that was removed is equal in magnitude and opposite in sign. A measurement of the amount of toner mass lost yields the toner specific charge, in microCoulombs per gram of toner.

For the present measurements, a polyvinylidene fluoride (PVDF) coated ferrite carrier (Canon 3000-4000 carrier, K101, Type TefV 150/250, Japan) with a mean particle size of about 150 microns was used. Toner samples (0.5 g per sample) were mixed with a carrier powder (9.5 g, Canon 3000-4000 carrier, K101, Type TefV 150/250, Japan)) to obtain a 5-weight percent toner content in the developer. This developer was gently agitated using a U.S. Stoneware mill mixer for 5 min, 15 min, and 30 min intervals before 0.2 g of the toner/carrier developer was analyzed using a Toshiba Blow-off tester to obtain the specific charge (in microCoulombs/gram) of each toner. Specific charge measurements were repeated at least three times for each toner to obtain a mean value and a standard deviation. The data was monitored for quality, namely, a visual observation that nearly all of the toner was blown-off of the carrier during the measurement. Tests were considered valid if nearly all of toner mass is blown-off from the carrier beads. Tests with low mass loss are rejected.

Conventional Differential Scanning Calorimetry

Thermal transition data for synthesized toner material was collected using a TA Instruments Model 2929 Differential Scanning Calorimeter (New Castle, Del.) equipped with a DSC refrigerated cooling system (−70° C. minimum temperature limit) and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5-10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature ($T_g$) value—values were reported from either the third or fourth heat ramp.

Graft stabilizer samples were prepared by precipitating and washing the sample in a non-solvent. The graft stabilizer samples were placed in an aluminum pan and dried in an oven at 100° C. for 1-2 hr. The organosol samples were placed in an aluminum pan and dried in an oven at 160° C. for 2-3 hr.

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/HEMA-TMI (97/3-4.7) is made by copolymerizing, on a relative basis, 97 parts by weight TCHMA and 3 parts by weight HEMA, and this hydroxy functional co-polymer was reacted with 4.7 parts by weight of TMI.

Similarly, a graft copolymer organosol designated TCHMA/HEMA-TMI//EMA (97/3-4.7//100) is made by copolymerizing the designated graft stabilizer (TCHMA/HEMA-TMI (97/3-4.7)) (S portion or shell) with the designated core monomer EMA (D portion or core, 100% EMA) at a specified ratio of D/S (core/shell) determined by the relative weights reported in the examples.

Graft Stabilizer Preparation

Example 1 (Comparative)

A 190 liter reactor equipped with a condenser, a thermocouple connected to a digital temperature controller, a nitrogen inlet tube connected to a source of dry nitrogen, and a mixer was charged with a mixture of 91.6 kg of Norpar™ 12 fluid, 30.1 kg of TCHMA, 0.95 kg of 98 wt % HEMA, and 0.39 kg of V-601. While stirring the mixture, the reactor was purged with dry nitrogen for 30 minutes at flow rate of approximately 2 liters/minute, and then the nitrogen flow rate was reduced to approximately 0.5 liters/min. The mixture was heated to 75° C. for 4 hours. The conversion was quantitative.

The mixture was heated to 100° C. for 1 hour to destroy any residual V-601 and then was cooled back to 70° C. The nitrogen inlet tube was then removed and 0.05 kg of 95% DBTDL was added to the mixture. Next, 1.47 kg of TMI was gradually added over the course of approximately 5 minutes into the continuously stirred reaction mixture. The mixture was allowed to react at 70° C. for 2 hours, at which time the conversion was quantitative.

The mixture was then cooled to room temperature to produce a viscous, transparent liquid containing no visible insoluble mater. The percent solids of the liquid mixture was determined to be 26.2 wt % using the drying method described above. Subsequent determination of molecular weight was made using the GPC method described above: the copolymer had an $M_w$ of 251,300 Da and $M_w/M_n$ of 2.8 based on two independent measurements. The product is a copolymer of TCHMA and HEMA containing random side chains of TMI attached to the HEMA and is designed herein as TCHMA/HEMA-TMI (97/3-4.7% w/w) and can be used to make an organosol. The shell co-polymer had a $T_g$ of 120° C.

Example 2 (Comparative)

A 190 liter reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 88.45 kg of Norpar™ 12 fluid, by vacuum. The vacuum was then broken and a flow of 28.32 liter/hr of nitrogen applied and the agitation is started at 70 RPM. 30.12 kg of TCHMA was added and the container rinsed with 1.22 kg of Norpar™ 12. 0.95 kg of 98 wt % HEMA was added and the container rinsed with 0.62 kg of Norpar™ 12. Finally 0.39 kg of V-601 was added and the container rinsed with 0.09 kg of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 28.32 liter/hr was applied. Agitation was resumed at 75 RPM and the mixture was heated to 75° C. and held for 4 hours. The conversion was quantitative.

The mixture was heated to 100° C. for 1 hour to destroy any residual V-601, and then was cooled back to 70° C. The nitrogen inlet tube was then removed, and 0.05 kg of 95 wt % DBTDL was added to the mixture using 0.62 kg of Norpar™ 12 to rinse container, followed by 1.47 kg of TMI. The TMI was gradually added over the course of approximately 5 minutes while stirring the reaction mixture and the container was rinsed with 0.64 kg of Norpar™ 12. The mixture was allowed to react at 70° C. for 2 hours, at which time the conversion was quantitative.

The mixture was then cooled to room temperature to produce a viscous, transparent liquid containing no visible insoluble matter. The percent solids of the liquid mixture were determined to be 26.0 wt % using the drying method described above. Subsequent determination of molecular weight was made using the GPC method described above; the copolymer had an $M_w$ of 251,300 Da and $M_w/M_n$ of 2.7 based on two independent measurements. The product is a copolymer of TCHMA and HEMA containing random side chains of TMI attached to the HEMA and is designed herein as TCHMA/HEMA-TMI (97/3-4.7% w/w) and can be used to make an organosol. The shell co-polymer had a $T_g$ of 124° C.

Example 3

A 5000 ml, 3-neck round flask equipped with a condenser, a thermocouple connected to a digital temperature controller, a nitrogen inlet tube connected to a source of dry nitrogen and a mechanical stirrer, was charged with a mixture of 2561 g of Norpar™ 12, 806.3 g of TCHMA, 42.4 g of St, 26.8 g of 98% HEMA and 8.75 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

The mixture was then heated to 90° C., held at that temperature for 1 hour to destroy any residual V-601, and then cooled back to 70° C. The nitrogen inlet tube was then removed and 13.6 g of 95% DBTDL were added to the mixture. Next, 41.1 g of TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature to produce a viscous, transparent liquid containing no visible insoluble mater. The percent solids of the liquid mixture was determined to be 25.7 wt % using the drying method described above. Subsequent determination of molecular weight was made using the GPC method described above; the copolymer had an $M_w$ of 187,600 Da and $M_w/M_n$ of 2.3 based on two independent measurements. The product was a copolymer of TCHMA, HEMA, and St containing random side chains of TMI attached to HEMA and was designed herein as TCHMA/HEMA.TMI/St (92.1/3.1-4.7/4.8 w/w) and suitable for making an organosol containing non-acidic groups in the shell. The shell co-polymer had a $T_g$ of 80° C.

Example 4

A 5000 ml, 3-neck round flask equipped with a condenser, a thermocouple connected to a digital temperature controller, a nitrogen inlet tube connected to a source of dry nitrogen and a mechanical stirrer, was charged with a mixture of 2561 g of Norpar™ 12, 844.5 g of TCHMA, 4.4 g of MAA, 26.8 g of 98% HEMA and 8.75 g of V-601. While stirring the mixture, the reaction flask was purged with dry nitrogen for 30 minutes at flow rate of approximately 2 liters/minute. A hollow glass stopper was inserted into the open end of the condenser and the nitrogen flow rate was reduced to approximately 0.5 liters/minute. The mixture was heated to 70° C. for 16 hours. The conversion was quantitative.

The mixture was then heated to 90° C. and held at that temperature for 1 hour to destroy any residual V-601, and then was cooled back to 70° C. The nitrogen inlet tube was then removed and 13.6 g of 95% DBTDL were added to the mixture. Next 41.1 g of TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature to produce a viscous, transparent liquid containing no visible insoluble mater. The percent solids of the liquid mixture was determined to be 26.5% using the drying method described above. Subsequent determination of molecular weight was made using the GPC method described above; the copolymer had an $M_w$ of 396,650 Da and $M_w/M_n$ of 2.7 based on two independent measurements. The product was a copolymer of TCHMA, HEMA, and MAA containing random side chains of TMI attached to HEMA and was designed herein as TCHMA/HEMA.TMI/MAA (96.4/3.1-4.7/0.5 w/w) and suitable for making an organosol containing acidic groups in the shell. The shell co-polymer had a $T_g$ of 96° C.

Example 5

A 5000 ml, 3-neck round flask equipped with a condenser, a thermocouple connected to a digital temperature controller, a nitrogen inlet tube connected to a source of dry nitrogen and a mechanical stirrer, was charged with a mixture of 2561 g of Norpar™ 12, 802 g of TCHMA, 42.4 g of St, 4.2 g of MAA, 26.8 g of 98% HEMA and 8.75 g of V-601. While stirring the mixture, the reaction flask was purged with dry nitrogen for 30 minutes at flow rate of approximately 2 liters/minute. A hollow glass stopper was inserted into the open end of the condenser and the nitrogen flow rate was reduced to approximately 0.5 liters/minute. The mixture was heated to 70° C. for 16 hours. The conversion was quantitative.

The mixture was then heated to 90° C. and held at that temperature for 1 hour to destroy any residual V-601, and then was cooled back to 70° C. The nitrogen inlet tube was then removed and 13.6 g of 95% DBTDL were added to the mixture. Next, 41.1 g of TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature to produce a viscous, transparent liquid containing no visible insoluble mater. The percent solids of the liquid mixture was determined to be 26.2% using the drying method described above. Subsequent determination of molecular weight was made using the GPC method described above; the copolymer had an $M_w$ of 170,450 Da and $M_w/M_n$ of 2.3 based on two independent measurements. The product was a copolymer of TCHMA, HEMA, St, and MAA containing random side chains of TMI attached to HEMA and was designed herein as TCHMA/HEMA.TMI/St/MAA (91.7/3-4.7/4.8/0.5 w/w) and suitable for making an organosol containing acidic groups in the shell. The shell co-polymer had a $T_g$ of 105° C.

Example 6

A 5000 ml, 3-neck round flask equipped with a condenser, a thermocouple connected to a digital temperature controller, a nitrogen inlet tube connected to a source of dry nitrogen and a mechanical stirrer, was charged with a mixture of 2562 g of Norpar™ 12, 796.25 g of TCHMA, 43.75 g of St, 8.75 g of nBA, 26.25 g of 98% HEMA and 8.75 g of AIBN. While stirring the mixture, the reaction flask was purged with dry nitrogen for 30 minutes at flow rate of approximately 2 liters/minute. A hollow glass stopper was inserted into the open end of the condenser and the nitrogen flow rate was reduced to approximately 0.5 liters/minute. The mixture was heated to 70° C. for 16 hours. The conversion was quantitative.

The mixture was then heated to 90° C. and held at that temperature for 1 hour to destroy any residual V-601, and then was cooled back to 70° C. The nitrogen inlet tube was then removed and 13.57 g of 95% DBTDL were added to the mixture. Next 41.13 g of TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature to produce a viscous, transparent liquid containing no visible insoluble mater. The percent solids of the liquid mixture was determined to be 25.7% using the drying method described above. Subsequent determination of molecular weight was made using the GPC method described above; the copolymer had an $M_w$ of 140,150 Da and $M_w/M_n$ of 2.2 based on two independent measurements. The product was a copolymer of TCHMA, HEMA, St, and nBA containing random side chains of TMI attached to HEMA and was designed herein as TCHMA/HEMA.TMI/St/nBA (91/3-4.7/5/1) w/w) and suitable for making an organosol containing non-acidic groups in the shell. The shell co-polymer had a $T_g$ of 122° C.

Example 7

A 5000 ml, 3-neck round flask equipped with a condenser, a thermocouple connected to a digital temperature controller, a nitrogen inlet tube connected to a source of dry nitrogen and a mechanical stirrer, was charged with a mixture of 2562 g of Norpar™ 12, 791.88 g of TCHMA, 43.75 g of St, 8.75 g of nBA, 4.38 g of MAA, 26.25 g of 98 wt % HEMA and 8.75 g of AIBN. While stirring the mixture, the reaction flask was purged with dry nitrogen for 30 minutes at flow rate of approximately 2 liters/minute. A hollow glass stopper was inserted into the open end of the condenser and the nitrogen flow rate was reduced to approximately 0.5 liters/minute. The mixture was heated to 70° C. for 16 hours. The conversion was quantitative.

The mixture was then heated to 90° C. and held at that temperature for 1 hour to destroy any residual V-601, and then was cooled back to 70° C. The nitrogen inlet tube was then removed and 13.57 g of 95 wt % DBTDL were added to the mixture. Next, 41.13 g of TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature to produce a viscous, transparent liquid containing no visible insoluble mater. The percent solids of the liquid mixture was determined to be 26.5 wt % using the drying method described above. Subsequent determination of molecular weight was made using the GPC method described above; the copolymer had an $M_w$ of 138,450 Da and $M_w/M_n$ of 2.2 based on two independent measurements. The product was a copolymer of TCHMA, HEMA, St, nBA, and MAA containing random side chains of TMI attached to HEMA and was designed herein as TCHMA/HEMA.TMI/St/nBA/

MAA (90.5/3-4.7/5/1/0.5 w/w) and suitable for making an organosol containing acidic groups in the shell. The shell co-polymer had a $T_g$ of 125° C.

Example 8

A 5000 ml, 3-neck round flask equipped with a condenser, a thermocouple connected to a digital temperature controller, a nitrogen inlet tube connected to a source of dry nitrogen and a mechanical stirrer, was charged with a mixture of 2562 g of Norpar™ 12 fluid, 791.88 g of TCHMA, 43.75 g of St, 8.75 g of nBA, 4.38 g of CEA, 26.25 g of 98 wt % HEMA and 8.75 g of AIBN. While stirring the mixture, the reaction flask was purged with dry nitrogen for 30 minutes at flow rate of approximately 2 liters/minute. A hollow glass stopper was inserted into the open end of the condenser and the nitrogen flow rate was reduced to approximately 0.5 liters/minute. The mixture was heated to 70° C. for 16 hours. The conversion was quantitative.

The mixture was then heated to 90° C. and held at that temperature for 1 hour to destroy any residual V-601, and then was cooled back to 70° C. The nitrogen inlet tube was then removed and 13.57 g of 95 wt % DBTDL were added to the mixture. Next, 41.13 g of TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was a viscous, transparent liquid containing visible insoluble CEA related matter so it was not used to make organosol.

Table 1 summarizes the graft stabilizers compositions of Examples 1 to 8.

TABLE 1

Graft Stabilizers Containing Acidic Groups

| Example Number | Graft Stabilizer Compositions (% w/w) | Solids (%) | Molecular Weight $M_w$ | $M_w/M_n$ |
|---|---|---|---|---|
| 1 (Comparative) | TCHMA/HEMA-TMI (97/3-4.7) | 26.2 | 251,300 | 2.8 |
| 2 (Comparative) | TCHMA/HEMA-TMI (97/3-4.7) | 26 | 251,300 | 2.7 |
| 3 | TCHMA/HEMA-TMI/St (92.1/3.1-4.7/4.8) | 25.7 | 187,600 | 2.3 |
| 4 | TCHMA/HEMA-TMI/MAA (96.4/3.1-4.7/0.5) | 26.5 | 396,650 | 2.7 |
| 5 | TCHMA-HEMA-TMI-St-MAA (91.7/3-4.7/4.8/0.5) | 26.2 | 170,450 | 2.3 |
| 6 | TCHMA-HEMA-TMI-St-nBA (91/3-4.7/5/1) | 25.7 | 140,150 | 2.2 |
| 7 | TCHMA-HEMA-TMI-St-nBA-MAA (90.5/3-4.7/5/1/0.5) | 26.5 | 138,450 | 2.2 |
| 8 | TCHMA-HEMA-TMI-St-nBA-CEA (90.6/2.9-4.7/5/1/0.5) | N/A | N/A | N/A |

Organosol Preparations

Example 9

This is a comparative example using the graft stabilizer in Example 1 to prepare an organosol containing no-acidic groups with a core/shell ratio of 8.2/1. A 5000 ml 3-neck round flask equipped with a condenser, a thermocouple connected to a digital temperature controller, a nitrogen inlet tube connected to a source of dry nitrogen and a mechanical stirrer, was charged with a mixture of 2567 g of Norpar™ 12 fluid, 296.86 g of the graft stabilizer mixture from Example 1 @ 26.2% polymer solids, 517.10 g of St, 105.12 g of nBA and 14 g of AIBN. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

Approximately 350 g of n-heptane was added to the cooled organosol. The resulting mixture was stripped of residual monomer using a rotary evaporator equipped with a dry ice/acetone condenser and operating at a temperature of 90° C. and using a vacuum of approximately 15 mm Hg. The stripped organosol was cooled to room temperature, yielding an opaque white dispersion.

This organosol was designed (TCHMA/HEMA-TMI//St/nBA) (97/3-4.7/83/17 w/w) and can be used to prepare toner formulations which had no acidic groups. The percent solids of the organosol dispersion after stripping was determined to be 19.9% using the drying method described above. Subsequent determination of average particles size was made using the laser diffraction method described above. The organosol particle had a volume average diameter 6.4 μm. The glass transition temperature of the organosol polymer was measured using DSC, as described above, was 74° C.

Example 10

This example illustrates the use of the graft stabilizer in Example 1 to prepare an organosol containing no acidic groups with a core/shell ratio of 8/1. Using the method and apparatus of Example 9, 2567 g of Norpar™ 12 fluid, 296.86 g of the graft stabilizer mixture from Example 1 @ 26.2% polymer solids, 517.10 g of St, 105.12 g of nBA, and 14 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA) (97/3-4.7//83/17) c/s8 and can be used to prepare toner formulations which have no acidic functional groups. The percent solids of the organosol dispersion after stripping was determined to be 18.5 wt % using the drying method described above. Subsequent determination of average particles size was made using the laser diffraction method described above. The organosol particle had a volume average diameter of 3.5 μm. The glass transition temperature of the organosol polymer was measured using DSC, as described above, was 75° C.

Example 11

This example illustrates the use of the graft stabilizer in Example 1 to prepare an organosol containing no acidic groups with a core/shell ratio of 14/1. Using the method and apparatus of Example 9, 2655 g of Norpar™ 12 fluid, 178.12 g of the graft stabilizer mixture from Example 1 @ 26.20% polymer solids, 542.96 g of St, 110.38 g of nBA, and 14 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St-nBA) (97/3-4.7//83/17) c/s 14 and can be used to prepare toner formulations which have no acidic functional groups. The fused ink film exhibited improved blocking and erasure resistance. The percent solids of the organosol dispersion after stripping was determined to be 21.9 wt % using the drying method described above. Subsequent determination of average particles size was made using the laser diffraction method described above. The organosol particle had a volume average diameter of 6.8 μm. The glass transition temperature of the organosol polymer was measured using DSC, as described above, was 67° C.

Example 12

This example illustrates the use of the graft stabilizer in Example 1 to prepare an organosol containing primary carboxyl groups in the core with a core/shell ratio of 8/1. Using the method and apparatus of Example 9, 2573 g of Norpar™ 12 fluid, 296.86 g of the graft stabilizer mixture from Example 1 @ 26.2% polymer solids, 486.08 g of St, 98.81 g of nBA, 35.09 g of MAA, and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St-nBA-MAA-6%) (97/3-4.7//78.4/15.9/5.7) c/s8 and can be used to prepare toner formulations which have acidic functional groups. The percent solids of the organosol dispersion after stripping was determined to be 16.8 wt % using the drying method described above. Subsequent determination of average particles size was made using the laser diffraction method described above. The organosol particle had a volume average diameter of 10.7 μm. The glass transition temperature of the organosol polymer was measured using DSC, as described above, was 76° C.

Example 13

This example illustrates the use of the graft stabilizer in Example 2 to prepare an organosol containing primary carboxyl groups in the core with a core/shell ratio of 2/1. Using the method and apparatus of Example 9, 2127 g of Norpar™ 12 fluid, 897.44 g of the graft stabilizer mixture from Example 2 @ 26% polymer solids, 364.56 g of St, 74.11 g of nBA, 26.32 g of MAA, and 10.50 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA/MAA) (97/3-4.7//78.4/15.9/5.7) c/s2 and can be used to prepare toner formulations which have acidic functional groups. The percent solids of the organosol dispersion after stripping was determined to be 17.7 wt % using the drying method described above. Subsequent determination of average particles size was made using the laser diffraction method described above. The organosol particle had a volume average diameter of 22.9 μm. The glass transition temperature of the organosol polymer was measured using DSC, as described above, was 72° C.

Example 14

This example illustrates the use of the graft stabilizer in Example 1 to prepare an organosol containing primary carboxyl groups in the core with a core/shell ratio of 8/1. Using the method and apparatus of Example 9, 2573 g of Norpar™ 12 fluid, 296.86 g of the graft stabilizer mixture from Example 1 @26.2% polymer solids, 486.08 g of St, 98.81 g of nBA, 35.09 g of CEA, and 10.50 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA/CEA) (97/3-4.7//78.4/15.9/5.7) c/s8 and can be used to prepare toner formulations which have acidic functional groups. The percent solids of the organosol dispersion after stripping was determined to be 15.4 wt % using the drying method described above. Subsequent determination of average particles size was made using the laser diffraction method described above. The organosol particle had a volume average diameter of 3.1 μm. The glass transition temperature of the organosol polymer was measured using DSC, as described above, was 77° C.

Example 15

This example illustrates the use of the graft stabilizer in Example 2 to prepare an organosol containing primary carboxyl groups in the core with a core/shell ratio of 8/1. Using the method and apparatus of Example 9, 2568 g of Norpar™ 12 fluid, 299.1 g of the graft stabilizer mixture from Example 2 @26% polymer solids, 501.4 g of St, 102.7 g of nBA, 18.1 g of MAA, and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA/MAA) (97/3-4.7//80.6/16.5/2.9) c/s8 and can be used to prepare toner formulations which have acidic functional groups. The percent solids of the organosol dispersion after stripping was determined to be 18.2 wt % using the drying method described above. Subsequent determination of average particles size was made using the laser diffraction method described above. The organosol particle had a volume average diameter of 12.8 μm. The glass transition temperature of the organosol polymer was measured using DSC, as described above, was 78° C.

Example 16

This example illustrates the use of the graft stabilizer in Example 2 to prepare an organosol containing primary carboxyl groups in the core with a core/shell ratio of 8/1. Using the method and apparatus of Example 9, 2568 g of Norpar™ 12 fluid, 299.1 g of the graft stabilizer mixture from Example 2 @ 26% polymer solids, 473.8 g of St, 97 g of nBA, 51.4 g of MAA, and 10.50 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA/MAA) (97/3-4.7//76.1/15.6/8.3) c/s8 and can be used to prepare toner formulations which have acidic functional groups. The percent solids of the organosol dispersion after stripping was determined to be 15.5 wt % using the drying method described above. Subsequent determination of average particles size was made using the laser diffraction method described above. The organosol particle had a volume average diameter of 13.4 μm. The glass transition temperature of the organosol polymer was measured using DSC, as described above, was 76° C.

Example 17

This example illustrates the use of the graft stabilizer in Example 3 to prepare an organosol containing no acidic groups with a core/shell ratio of 8/1. Using the method and apparatus of Example 9, 2565 g of Norpar™ 12 fluid, 302.6 g of the graft stabilizer mixture from Example 3 @ 25.7% polymer solids, 622.2 g EMA and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/St//EMA) (92.1/3.1-4.7/4.8//100) c/s8 and can be used to prepare toner formulations which have no acidic functional groups. The percent solids of the organosol dispersion after stripping was determined to be 16.3 wt % using the drying method described above. Subsequent determination of average particles size was made using the laser diffraction method described above. The organosol particle had a volume average diameter of 17.8 μm. The glass transition temperature of the organosol polymer was measured using DSC, as described above, was 68° C.

Example 18

This example illustrates the use of the graft stabilizer in Example 4 to prepare an organosol containing primary carboxyl groups in the shell with a core/shell ratio of 8/1. Using the method and apparatus of Example 9, 2574 g of Norpar™ 12 fluid, 293.5 g of the graft stabilizer mixture from Example 4 @ 26.5% polymer solids, 622.2 g of EMA and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/MAA//EMA) (96.4/3.1-4.7/0.5//100) c/s8 and can be used to prepare toner formulations which have acidic functional groups. The percent solids of the organosol dispersion after stripping was determined to be 16.7 wt % using the drying method described above. Subsequent determination of average particles size was made using the laser diffraction method described above. The organosol particle had a volume average diameter of 17.4 μm. The glass transition temperature of the organosol polymer was measured using DSC, as described above, was 68° C.

Example 19

This example illustrates the use of the graft stabilizer in Example 5 to prepare an organosol containing primary carboxyl groups in the shell with a core/shell ratio of 8/1. Using the method and apparatus of Example 9, 2570 g of Norpar™ 12 fluid, 296.9 g of the graft stabilizer mixture from Example 5 @ 26.2% polymer solids, 622.2 g of EMA and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/St/MAA//EMA) (91.7/3-4.7/4.8/0.5//100) c/s 8 and can be used to prepare toner formulations which have acidic functional groups. The percent solids of the organosol dispersion after stripping was determined to be 19.6 wt % using the drying method described above. Subsequent determination of average particles size was made using the laser diffraction method described above. The organosol particle had a volume average diameter of 12.7 μm. The glass transition temperature of the organosol polymer was measured using DSC, as described above, was 69° C.

Example 20

This example illustrates the use of the graft stabilizer in Example 5 to prepare an organosol containing primary carboxyl groups in the shell with a core/shell ratio of 2/1. Using the method and apparatus of Example 9, 2132 g of Norpar™ 12 fluid, 890.6 g of the graft stabilizer mixture from Example 5 @ 26.2% polymer solids, 466.7 g of EMA and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/St/MAA//EMA) (91.7/3-4.7/4.8/0.5//100) c/s2 and can be used to prepare toner formulations which have acidic functional groups. The percent solids of the organosol dispersion after stripping was determined to be 12.2 wt % using the drying method described above. Subsequent determination of average particles size was made using the laser diffraction method described above. The organosol particle had a volume average diameter of 38.7 μm. The glass transition temperature of the organosol polymer was measured using DSC, as described above, was 80° C.

Example 21

This example illustrates the use of the graft stabilizer in Example 6 to prepare an organosol containing no acidic with a core/shell ratio of 8/1. Using the method and apparatus of Example 9, 2565 g of Norpar™ 12 fluid, 302.6 g of the graft stabilizer mixture from Example 6 @ 25.7% polymer solids, 622.2 g of EMA and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/St/nBA//EMA) (91/3-4.7/5/1//100) c/s8 and can be used to prepare toner formulations which have no acidic functional groups. The percent solids of the organosol dispersion after stripping was determined to be 19.7 wt % using the drying method described above. Subsequent determination of average particles size was made using the laser diffraction method described above. The organosol particle had a volume average diameter of 25.5 μm. The glass transition temperature of the organosol polymer was measured using DSC, as described above, was 75° C.

Example 22

This example illustrates the use of the graft stabilizer in Example 7 to prepare an organosol containing primary carboxyl groups in the shell with a core/shell ratio of 8/1. Using the method and apparatus of Example 9, 2574 g of Norpar™ 12 fluid, 293.5 g of the graft stabilizer mixture from Example 7 @ 26.5% polymer solids, 622.2 g of EMA and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/St/nBA/MAA//EMA) (90.5/3-4.7/5/1/0.5//100) c/s8 and can be used to prepare toner formulations which have acidic functional groups. The percent solids of the organosol dispersion after stripping was determined to be 19.2 wt % using the drying method described above. Subsequent determination of average particles size was made using the laser diffraction method described above. The organosol particle had a volume average diameter of 21.5 μm. The glass transition temperature of the organosol polymer was measured using DSC, as described above, was 64° C.

Example 23

This example illustrates the use of the graft stabilizer in Example 1 to prepare an organosol containing primary carboxyl groups in the shell with a core/shell ratio of 8/1. Using the method and apparatus of Example 9, 2573 g of Norpar™ 12 fluid, 296.86 g of the graft stabilizer mixture from Example 1 @ 26.2% polymer solids, 486.08 g of St, 98.81 g n-BA, 35.09 g of MAA, and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA/MAA) (97/3-4.7//78.4/15.9/5.7) c/s8 and can be used to prepare toner formulations which have acidic functional groups. The percent solids of the organosol dispersion after stripping was determined to be 17.6 wt % using the drying method described above. Subsequent determination of average particles size was made using the laser diffraction method described above. The organosol particle had a volume average diameter of 13.9 μm. The glass transition temperature of the organosol polymer was measured using DSC, as described above, was 75° C.

Example 24

This example illustrates the use of the graft stabilizer in Example 1 to prepare an organosol containing primary carboxyl groups in the shell with a core/shell ratio of 8/1. Using the method and apparatus of Example 9, 2573 g of Norpar™ 12 fluid, 296.86 g of the graft stabilizer mixture from Example 1 @ 26.2% polymer solids, 486.08 g of St, 98.81 g of n-BA, 35.09 g of MAA, and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI//St/nBA/MAA) (97/3-4.7//78.4/15.9/5.7) c/s8 and can be used to prepare toner formulations which have acidic functional groups. The percent solids of the organosol dispersion after stripping was determined to be 16.3 wt % using the drying method described above. Subsequent determination of average particles size was made using the laser diffraction method described above. The organosol particle had a volume average diameter of 11.1 μm. The glass transition temperature of the organosol polymer was measured using DSC, as described above, was 76° C.

Example 25

This example illustrates the use of the graft stabilizer in Example 7 to prepare an organosol containing primary carboxyl groups in the shell with a core/shell ratio of 8/1. Using the method and apparatus of Example 9, 2573.8 g of Norpar™ 12 fluid, 293.5 g of the graft stabilizer mixture from Example 7 @ 26.5% polymer solids, 473.8 g of St, 97 g of n-BA, 51.4 g of MAA, and 10.5 g of AIBN were combined. The mixture was heated to 70° C. for 16 hours. The conversion was quantitative. The mixture then was cooled to room temperature. After stripping the organosol using the method of Example 9 to remove residual monomer, the stripped organosol was cooled to room temperature, yielding an opaque white dispersion. This organosol was designed (TCHMA/HEMA-TMI/St/n-BA/MAA//St/n-BA/MAA) (90.5/3-4.7/5/1/0.5//76.1/15.6/8.3) c/s8 and can be used to prepare toner formulations which have acidic functional groups. The percent solids of the organosol dispersion after stripping was determined to be 14.3 wt % using the drying method described above. Subsequent determination of average particles size was made using the laser diffraction method described above. The organosol particle had a volume average diameter of 5.9 μm. The glass transition temperature of the organosol polymer was measured using DSC, as described above, was 75° C.

Table 2 summarizes the organosol copolymer compositions of Examples 9 to 25.

TABLE 2

Organosols Containing Acidic Groups

| Example Number | Organosol Compositions (% w/w) (Core/shell ("c/s") ratio) | Acidic Group Location |
|---|---|---|
| 9 | TCHMA/HEMA-TMI//St/nBA (97/3-4.7//83/17) c/s 8.2 | None |
| 10 | TCHMA/HEMA-TMI//St/nBA (97/3-4.7//83/17) c/s 8 | None |
| 11 | TCHMA/HEMA-TMI//St/nBA (97/3-4.7//83/17) c/s 14 | None |
| 12 | TCHMA/HEMA-TMI//St/nBA/MAA (97/3-4.7//78.4/15.9/5.7) c/s 8 | Core |
| 13 | TCHMA/HEMA-TMI//St/nBA/MAA (97/3-4.7//78.4/15.9/5.7) c/s 2 | Core |
| 14 | TCHMA/HEMA-TMI//St/nBA/CEA (97/3-4.7//78.4/15.9/5.7) c/s 8 | Core |
| 15 | TCHMA/HEMA-TMI//St/nBA/MAA (97/3-4.7//80.6/16.5/2.9) c/s 8 | Core |
| 16 | TCHMA/HEMA-TMI//St/nBA/MAA (97/3-4.7//76.1/15.6/8.3) c/s 8 | Core |
| 17 | TCHMA/HEMA-TMI/St//EMA (92.1/3.1-4.7/4.85//100) c/s 8 | None |
| 18 | TCHMA/HEMA-TMI/MAA//EMA (96.4/3.1-4.7/0.5//100) c/s 8 | Shell |
| 19 | TCHMA/HEMA-TMI/St/MAA//EMA (91.7/3-4.7/4.8/0.5//100) c/s 8 | Shell |
| 20 | TCHMA/HEMA-TMI/St/MAA//EMA (91.7/3-4.7/4.8/0.5//100) c/s 2 | Shell |
| 21 | TCHMA/HEMA-TMI/St/nBA//EMA (91/3-4.7/5/1//100) c/s 8 | None |
| 22 | TCHMA/HEMA-TMI/St/nBA/MAA//EMA (90.5/3-4.7/5/1/0.5//100) c/s 8 | Shell |
| 23 | TCHMA/HEMA-TMI//St/nBA/MAA (97/3-4.7//78.4/15.9/5.7) c/s 8 | Core |
| 24 | TCHMA/HEMA-TMI//St/nBA/MAA (97/3-4.7//78.4/15.9/5.7) c/s 8 | Core |
| 25 | TCHMA/HEMA-TMI/St/n-BA/MAA//St/n-BA/MAA (90.5/3-4.7/5/1/0.5//76.1/15.6/8.3) c/s 8 | Core & Shell |

Preparation of Liquid Inks and Subsequent Preparation of Dry Toners

Example 26

This example illustrates the use of the organosol in Example 9 to prepare a liquid toner. 1421 g of organosol @ 19.9% (w/w) solids in Norpar™ 12 fluid was combined with 727 g of Norpar™ 12 fluid, 47 g of Cabot Black Pigment Mogul L (Cabot Corporation, Billerica, Mass.), and 4.43 g of 26.6% Zirconium HEX-CEM solution (OMG Chemical Company, Cleveland, Ohio). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 3 minutes. The percent solids of the toner concentrate was determined to be 14.7% (w/w) using the drying method described above and exhibited a volume mean particle size of 6.7 microns. Average particle size was determined using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 27

This example illustrates the use of the organosol in Example 10 to prepare a liquid toner. 1130 g of organosol @ 18.5% (w/w) solids in Norpar™ 12 fluid was combined with 1059 g of Norpar™ 12 fluid, 11 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 2 minutes. The percent solids of the toner concentrate was determined to be 8.7% (w/w) using the drying method described above and exhibited a volume mean particle size of 3.8 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 28

This example illustrates the use of the organosol in Example 11 to prepare a liquid toner. 1432 g of organosol @ 21.9% (w/w) solids in Norpar™ 12 fluid was combined with 752 g of Norpar™ 12 fluid, 17 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 2 minutes. The percent solids of the toner concentrate was determined to be 16.2% (w/w) using the drying method described above and exhibited a volume mean particle size 5.7 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 29

This example illustrates the use of the organosol in Example 12 to prepare a liquid toner. 1684 g of organosol @ 16.8% (w/w) solids in Norpar™ 12 fluid was combined with 469 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 6 minutes. The percent solids of the toner concentrate was determined to be 14.4% (w/w) using the drying method described above and exhibited a volume mean particle size of 7.9 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 30

This example illustrates the use of the organosol in Example 13 to prepare a liquid toner. 994 g of organosol @ 17.7% (w/w) solids in Norpar™ 12 fluid was combined with 1118 g of Norpar™ 12 fluid, 88 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 22 minutes. The percent solids of the toner concentrate was determined to be 11.6% (w/w) using the drying method described above and exhibited a volume mean particle size of 7.2 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 31

This example illustrates the use of the organosol in Example 14 to prepare a liquid toner. 1357 g of organosol @ 15.4% (w/w) solids in Norpar™ 12 fluid was combined with 832 g of Norpar™ 12 fluid, 11 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 1 minute. The percent solids of the toner concentrate was determined to be 9.9% (w/w) using the drying method described above and exhibited a volume mean particle size of 4.3 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 32

This example illustrates the use of the organosol in Example 15 to prepare a liquid toner. 1554 g of organosol @ 18.2% (w/w) solids in Norpar™ 12 fluid was combined with 599 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 6 minutes. The percent solids of the toner concentrate was determined to be 14.5% (w/w) using the drying method described above and exhibited a volume mean particle size of 7.1 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 33

This example illustrates the use of the organosol in Example 16 to prepare a liquid toner. 1825 g of organosol @ 15.5% (w/w) solids in Norpar™ 12 fluid was combined with 328 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 7 minutes. The percent solids of the toner concentrate was determined to be 12.2% (w/w) using the drying method described above and exhibited a volume mean particle size of 6.8 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 34

This example illustrates the use of the organosol in Example 17 to prepare a liquid toner. 1735 g of organosol @ 16.3% (w/w) solids in Norpar™ 12 fluid was combined with 418 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 78 minutes. The percent solids of the toner concentrate was determined to be 14.8% (w/w) using the drying method described above and exhibited a volume mean particle size of 6.0 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 35

This example illustrates the use of the organosol in Example 18 to prepare a liquid toner. 1694 g of organosol @ 16.7% (w/w) solids in Norpar™ 12 fluid was combined with 459 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 50 minutes. The percent solids of the toner concentrate was determined to be 14.4% (w/w) using the drying method described above and exhibited a volume mean particle size of 6.3 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 36

This example illustrates the use of the organosol in Example 19 to prepare a liquid toner. 1443 g of organosol @ 19.6% (w/w) solids in Norpar™ 12 fluid was combined with 710 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 106 minutes. The percent solids of the toner concentrate was determined to be 13.2% (w/w) using the drying method described above and exhibited a volume mean particle size of 8.2 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 37

This example illustrates the use of the organosol in Example 20 to prepare a liquid toner. 2009 g of organosol @ 12.2% (w/w) solids in Norpar™ 12 fluid was combined with 150 g of Norpar™ 12 fluid, 41 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 30 minutes. The percent solids of the toner concentrate was determined to be 14.2% (w/w) using the drying method described above and exhibited a volume mean particle size of 9.5 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 38

This example illustrates the use of the organosol in Example 21 to prepare a liquid toner. 1436 g of organosol @ 19.7% (w/w) solids in Norpar™ 12 fluid was combined with 717 g of Norpar™ 12 fluid, 47 g of Cabot Black Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 65 minutes. The percent solids of the toner concentrate was determined to be 11.4% (w/w) using the drying method described above and exhibited a volume mean particle size of 8.4 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 39

This example illustrates the use of the organosol in Example 22 to prepare a liquid toner. 1473 g of organosol @ 19.2% (w/w) solids in Norpar™ 12 fluid was combined with 680 g of Norpar™ 12 fluid, 47 g of Cabot Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 76 minutes. The percent solids of the toner concentrate was determined to be 11.7% (w/w) using the drying method described above and exhibited a volume mean particle size of 8.3 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 40

This example illustrates the use of the organosol in Example 23 to prepare a liquid toner. 1607 g of organosol @ 17.6% (w/w) solids in Norpar™ 12 fluid was combined with 546 g of Norpar™ 12 fluid, 47 g of Cabot Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 42 minutes. The percent solids of the toner concentrate was determined to be 14.8% (w/w) using the drying method described above and exhibited a volume mean particle size of 5.6 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 41

This example illustrates the use of the organosol in Example 24 to prepare a liquid toner. 1282 g of organosol @ 16.3% (w/w) solids in Norpar™ 12 fluid was combined with 907 g of Norpar™ 12 fluid, 11 g of Cabot Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 35 minutes. The percent solids of the toner concentrate was determined to be 9.7% (w/w) using the drying method described above and exhibited a volume mean particle size of 6.2 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Example 42

This example illustrates the use of the organosol in Example 25 to prepare a liquid toner. 1978 g of organosol @ 14.3% (w/w) solids in Norpar™ 12 fluid was combined with 175 g of Norpar™ 12 fluid, 47 g of Cabot Pigment Mogul L (Cabot Corporation, Billerica, Mass.). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM for with chilled water circulating through the jacket of the milling chamber temperature at 21° C. Milling time was 5 minutes. The percent solids of the toner concentrate was determined to be 14.5% (w/w) using the drying method described above and exhibited a volume mean particle size of 4.9 microns. Average particle size was made using the Horiba LA-920 laser diffraction method described above.

The dry toner sample was prepared by coating out 20 ml of the sample obtained above using a #30 wire Meyer bar onto 15"×24" section of aluminized polyester sheet. The sample was allowed to dry for 40-50 hours at ambient temperature and humidity on a flat surface. After this time, the dry toner was collected by scrapping off the sample from the aluminize polyester using a disposable broad, wooden spatula and the powder was immediately preserved in a small screw-capped, glass jar. Average dry toner particle size was made using the Horiba LA-900 laser diffraction method described above.

Table 3 summarizes the measured volume average dry toner particle size and the toner charge per mass (Q/M) after 5, 15, and 30 min of agitation for each of the prepared toner compositions described in the preceding Examples.

TABLE 3

Dry Toner Charge and Particle Size

| Example # | $D_v$ (μm) | Q/M (μC/g) 5 min | 15 min | 30 min |
|---|---|---|---|---|
| 26 | 8.0 | −7.58 | −8.78 | −14.88 |
| 27 | 7.9 | −2.20 | −3.00 | −2.70 |
| 28 | 6.4 | −5.71 | −7.59 | −8.00 |
| 29 | 7.7 | −43.18 | −28.73 | −31.94 |
| 30 | 14.7 | −7.36 | −6.88 | −4.80 |
| 31 | 7.0 | −13.40 | −14.86 | −16.26 |
| 32 | 5.1 | −24.25 | −37.03 | −31.09 |
| 33 | 6.0 | −29.11 | −22.95 | −23.15 |
| 34 | 6.4 | −7.77 | −1.59 | 5.10 |
| 35 | 10.3 | −13.81 | −9.15 | −6.70 |
| 36 | 6.3 | −9.75 | −5.70 | −2.99 |
| 37 | 15.3 | −3.58 | 0.37 | 4.20 |
| 38 | 5.3 | 3.59 | 12.38 | 14.17 |
| 39 | 8.7 | −4.38 | 1.19 | 2.24 |
| 40 | 7.0 | −17.06 | −14.76 | −14.76 |
| 41 | 9.0 | −18.17 | −23.24 | −24.94 |
| 42 | 8.9 | −24.37 | −23.66 | −23.10 |

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A dry electrophotographic toner composition, comprising:

an amphipathic copolymer comprising one or more S material portions and one or more D material portions, wherein the amphipathic copolymer comprises at least one acidic functionality covalently bonded to the amphipathic copolymer, wherein the absolute difference between the respective Hildebrand solubility parameters of the S portion(s) of the copolymer and a liquid carrier having a Hildebrand solubility parameter of from about 13 to about 15 $MPa^{1/2}$ is less than 2.0 $MPa^{1/2}$; and wherein the S portion has a polydispersity of from 2.2 to 2.7.

2. The dry electrophotographic toner composition according to claim 1, wherein the acidic functionality is bonded to the S material portion of the amphipathic copolymer.

3. The dry electrophotographic toner composition according to claim 1, wherein the acidic functionality is bonded to the D material portion of the amphipathic copolymer.

4. The dry electrophotographic toner composition according to claim 1, wherein the acidic functionality is bonded to the S material portion and the D material portion of the amphipathic copolymer.

5. The dry electrophotographic toner composition according to claim 1, wherein acidic functionality is provided by incorporation of one or more acidic-functional polymerizable compounds in the amphipathic copolymer.

6. The dry electrophotographic toner composition according to claim 5, wherein the acidic-functional polymerizable compounds comprise greater than about 1% by weight of the total amphipathic copolymer.

7. The dry electrophotographic toner composition according to claim 5, wherein the acidic-functional polymerizable compounds comprise from about 2 to about 8% by weight of the total amphipathic copolymer.

8. The dry electrophotographic toner composition according to claim 1, wherein the acidic functionality is selected from carboxylic acids, sulfonic acids and phosphoric acids.

9. The dry electrophotographic toner composition according to claim 1, wherein the amphipathic copolymer is a (meth)acrylate graft copolymer, and the acidic functionality is provided by acidic-functional polymerizable compounds selected from the group consisting of acrylic acid, 2-acrylamido-2-methyl propane sulfonic acid, 2-carboxyethyl acrylate, crotonic acid, itaconic acid, maleic acid, methacrylic acid, pentaerythritol dimethacrylate, styrene sulfonic acid, 4-vinyl benzoic acid, and mixtures thereof.

10. The dry electrophotographic toner composition according to claim 1, wherein the S material portion of the amphipathic copolymer is prepared from polymerizable compounds comprising acidic-functional polymerizable compounds selected from the group consisting of methacrylic acid and 2-carboxyethyl acrylate.

11. The dry electrophotographic toner composition according to claim 1, wherein the S material portion of the amphipathic copolymer is prepared from polymerizable compounds comprising trimethyl cyclohexyl methacrylate, 2-hydroxyethyl methacrylate, n-butyl acrylate, styrene, methacrylic acid and dimethyl-m-isopropenyl benzyl isocyanate.

12. The dry electrophotographic toner composition according to claim 1, wherein the D material portion of the amphipathic copolymer is prepared from polymerizable compounds comprising acidic-functional polymerizable compounds selected from the group consisting of methacrylic acid and 2-carboxyethyl acrylate.

13. The dry electrophotographic toner composition according to claim 1, wherein the D material portion of the amphipathic copolymer is prepared from polymerizable compounds comprising n-butyl acrylate, styrene and methacrylic acid.

14. The dry electrophotographic toner composition according to claim 1, wherein the composition is negatively charged.

15. The dry electrophotographic toner composition according to claim 14, wherein the composition is substantially free of charge control agent.

16. The dry electrophotographic toner composition according to claim 1, wherein the composition is negatively charged, and comprises positively charged charge control agent.

17. The dry electrophotographic toner composition according to claim 1, wherein the composition is positively charged, and comprises positively charged charge control agent.

18. The dry electrophotographic toner composition according to claim 1, wherein the composition comprises a visual enhancement additive.

19. The dry electrophotographic toner composition according to claim 1, wherein the absolute difference between the respective Hildebrand solubility parameters of the S portion(s) of the copolymer and a liquid carrier having a Hildebrand solability parameter of from about 13 to about 15 $MPa^{1/2}$ is less than 1.5 $MPa^{1/2}$.

* * * * *